United States Patent [19]

Amano et al.

[11] Patent Number: 4,837,698

[45] Date of Patent: Jun. 6, 1989

[54] METHOD OF CONTROLLING AIR-FUEL RATIO

[75] Inventors: Matsuo Amano, Hitachi; Masami Shida, Mito; Masahide Sakamoto, Katsuta; Takeshi Hirayama, Mito; Takao Sasayama, Hitachi, all of Japan

[73] Assignee: Hitachi, Ltd., Tokyo, Japan

[21] Appl. No.: 112,146

[22] Filed: Oct. 26, 1987

Related U.S. Application Data

[62] Division of Ser. No. 672,591, Nov. 19, 1984, Pat. No. 4,703,430.

[30] Foreign Application Priority Data

Nov. 21, 1983 [JP] Japan ..... 58-217838
Mar. 10, 1984 [JP] Japan ..... 59-44835

[51] Int. Cl.[4] ..... F02D 41/00

[52] U.S. Cl. ..... 364/431.07; 364/431.05; 123/492; 123/493; 123/480

[58] Field of Search ..... 364/431.05, 431.07, 364/431.11; 123/440, 480, 489, 492, 493

[56] References Cited

U.S. PATENT DOCUMENTS 4,348,727 9/1982 Kobayashi et al. ..... 364/431.05 X
4,416,237 11/1983 Aoki et al. ..... 123/493 X
4,442,815 4/1984 Ninomiya ..... 364/431.05 X
4,461,261 7/1984 Isomura et al. ..... 123/480 X
4,466,411 8/1984 Hasegawa et al. ..... 123/480
4,487,190 12/1984 Isobe ..... 123/493 X
4,508,075 4/1985 Takao et al. ..... 123/480 X
4,510,910 4/1985 Ninomiya et al. ..... 123/480 X
4,517,948 5/1985 Kaji et al. ..... 123/489
4,517,949 5/1985 Ito et al. ..... 123/489
4,530,333 7/1985 Nishimura ..... 123/480 X
4,566,420 1/1986 Sakanuto et al. ..... 123/480 X
4,616,619 10/1986 Saito et al. ..... 123/493 X

*Primary Examiner*—Parshotam S. Lall
*Assistant Examiner*—V. N. Trans
*Attorney, Agent, or Firm*—Antonelli, Terry & Wands

[57] ABSTRACT

A novel method of controlling air-fuel ratio for an internal combustion engine is disclosed, which comprises a memory area for holding regional compensation factors used for air-fuel ratio control, a memory area for holding new regional compensation factors obtained by learning, and a memory area for holding regional compensation factors based on the result of the learning immediately before the latest learning, thus rationalizing the new setting and updating proceses of regional compensation factors according to the result of learning.

19 Claims, 12 Drawing Sheets

METHOD OF CONTROLLING AIR-FUEL RATIO

This is a division of application Ser. No. 672,591, filed Nov. 19, 1984 now U.S. Pat. No. 4,703,430.

BACKGROUND OF THE INVENTION

The present invention relates to an electronic fuel supply control method for an automotive engine, or more in particular to a control system equipped with a learning function capable of control under optimum control parameters.

In an internal combustion engine such as a gasoline engine (hereinafter referred to as "the engine"), it is necessary to maintain the amount of fuel supply at a predetermined ratio to the intake, air thereby to keep the air-fuel ratio (A/F) at the right level.

Conventionally, a predetermined air-fuel ratio is obtained by measuring the amount of intake air and by controlling the amount of fuel supply accordingly. However, with this method, satisfactory control is impossible when emission control is taken into consideration.

The trend has thus changed toward the use of an oxygen sensor with zirconia by which the condition of the exhaust gas is detected and the amount of fuel supply is controlled by feedback in what is called the oxygen feedback control system.

In the oxygen feedback control system, a basic fuel supply amount based on the fuel supply amount determined by the above-mentioned amount or flow rate of intake air is compensated for by feedback in a manner to converge the output air-fuel ratio to a predetermined value. As a result, it is possible to drive an automobile always at a predetermined air-fuel ratio even in the case where the air-fuel ratio could not otherwise be kept correctly by controlling the basic fuel supply amount alone.

An example of the engine control system equipped with such an oxygen feedback control device is shown in FIG. 1.

In FIG. 1, reference numeral 1 designates an electronic control system including a microcomputer system, numeral 2 an engine, numeral 3 an oxygen sensor mounted on the exhaust manifold of the engine to determine the output air-fuel ratio from the oxygen concentration of the exhaust, and numeral 4 an injector mounted on the engine intake manifold to inject the fuel.

The electronic control device 1 determines the engine operating conditions in response to the engine intake air flow rate Qa, the engine speed N, the temperature of the cooling water and the battery voltage supplied from sensors not shown, and drives the injector 4 to inject the fuel after further correcting the operating conditions with a signal from the oxygen sensor 3.

The fuel is injected from the injector 4 by periodic interruption in synchronism with the engine revolutions, and therefore, the fuel supply amount is controlled by controlling the fuel injection time of each injection of the injector 4. The injection time Ti is given as $$Ti = K \cdot Tp \cdot \alpha \cdot \Sigma Ki \quad (1)$$

$$Tp = Qa/N \quad (2)$$

where

K: A factor determined by injector

Tp: Basic fuel injection time $\alpha$: Air-fuel ratio control factor

Ki: Various compensation factors

Qa: Intake air flow rate

N: Engine speed (revolutional speed)

As apparent from this equation, the basic fuel injection time Tp is determined by the engine operating conditions, and therefore, it makes up a basic supply amount. In the oxygen feed back method, the control factor $\alpha$is changed so that the output of the oxygen sensor 3 alternates between rich and lean states to keep the mean output air-fuel ratio at a predetermined value, that is, a stoichiometric air-fuel ratio (A/F=14.7).

If the basic injection time Tp is kept at the ideal state, the control factor $\alpha$ pulsates up and down around the level 1.0 and the mean value thereof is 1.0. If the air-fuel ratio based on the basic injection time Tp has changed to the lean side, on the other hand, the control factor $\alpha$ pulsates around 1.1 in an attempt to correct the situation, while if the air-fuel ratio became 10% richer, the factor $\alpha$ reciprocates around the level of about 0.9. In each case, the system works to make the output air-fuel ratio an ideal value, and even when the air-fuel ratio given by the basic fuel injection time Tp is displaced from the ideal state, the output airfuel ratio is always kept ideal to prevent the exhaust gas from deteriorating.

In application of this oxygen feedback control method, the response speed thereof has its own practical limit. In the event that the air-fuel ratio based on the basic supply amount undergoes a sudden change, the control operation fails to follow a sudden change of the air-fuel ratio, with the result that the mean value of the output air-fuel ratio deviates from the stoichiometric air-fuel ratio during the transient period before the mean value is converged to a predetermined value, thus deteriorating the exhaust gas. Such a sudden change in the air-fuel ratio based on the basic fuel supply amount is often caused in such cases as when the engine transfers from abrupt acceleration to an engine braked state.

In order to obviate this problem of the oxygen feedback control system, a control method has been suggested and found applications, in which the engine operating conditions are divided into a plurality of regions according to the engine speed or intake air flow rate, and a compensation factor is predetermined for the basic fuel supply amount for each operating region, so that the basic fuel supply amount is corrected by the compensation factor for each engine operating region, thereby keeping the amount of oxygen feedback control substantially unchanged as required against the stoichiometric air-fuel ratio even when the engine operating conditions undergo a change.

In this method, the injection time Ti of the injector 4 is determined by the equation below.

$$Ti = K \cdot Tp \cdot \alpha \cdot Kr \cdot \Sigma Ki \quad (3)$$

where Kr is a regional compensation factor.

This method is such that the range of engine speed change and the range of intake air amount change are divided into, say, ten parts respectively, and a total of 100 operating regions are determined by various combinations of the divisions. A regional compensation factor Kr is determined in such a manner as to obtain a stoichiometric air-fuel ratio (=14.7) when the control factor $\alpha$ is 1.0, that is, when the oxygen feedback control is lacking, for each operating region. The compensation factors thus determined are stored in a memory such as a ROM and are read from time to time during engine operation to calculate the injection time Ti. In this way, it is possible to keep the mean value of the control factor $\alpha$ substantially at 1.0 to achieve the stoichiometric air-fuel ratio and thus the transient deterioration of the exhaust gas which otherwise would occur due to the delayed response of the oxygen feedback control is prevented in any operating region to which the engine operating conditions may change.

The engine control characteristics greatly vary from one engine to another by characteristic variations of the engine or various sensors or actuators used for control thereof.

For this reason, it is substantially useless if a compensation factor Kr required in the regional compensation system which is determined for a standard engine is applied to all other engines. A regional compensation factor Kr must instead be determined independently for each engine and a ROM exclusive to the particular engine is required to store the data. This is, however, impossible to implement as it leads to a lower productivity and increased cost.

The characteristics of the engine, sensors and actuators, on the other hand, are subject to secular variations due to aging, and therefore, the setting of a regional compensation factor during the production process will often become almost meaningless after the lapse of some period of use of the engine.

In view of this, a learning control system has recently been developed. In this system, a non-volatile memory in which data can be written or rewritten is used to store the regional compensation factor Kr, which is sequentially written for each operating region by a "learning" process during engine operation, so that an accurate regional compensation factor Kr is always provide for air-fuel control on the basis of the latest operating results. The basic concept of such a learning control system is disclosed in the Japanese Patents Laid-Open Nos. 20231/79 and 57029/79.

The learning control system eliminates the need of determining a regional compensation factor beforehand, and in case of any change in engine characteristics, etc., enables the regional compensation factor to be corrected by itself from time to time, so that correct control is always possible to prevent the deterioration of the exhaust gas under all operating conditions including the transient period.

In practice, however, this control system fails to produce a sufficient effect, since the engine operations are concentrated in a part of the regions with most of the regional compensation factors left uncorrected.

SUMMARY OF THE INVENTION

Accordingly, the object of the present invention is to provide an air-fuel control system in which the compensation factors can be corrected by a comparatively simple method over wide regions to fully display the effect of the learning control.

In order to achieve this object, there is provided according to the present invention a method of air-fuel control comprising a memory area for holding regional compensation factors used for air-fuel ratio control, a memory area for holding new regional compensation factors obtained by a learning process, and a memory area for holding regional compensation factors based on the result of the learning operation occurring immediately before the storage of the result of the latest learning operation, thereby rationalizing the processes of setting and updating the regional compensation factors according to the result of the learning.

According to another aspect of the present invention, it is decided whether or not a regional compensation factor is properly corrected, and any compensation factor that has not been so corrected is corrected on the basis of a corrected compensation factor, with the result that even a regional compensation factor for a region where engine operation is not frequent is corrected, thus improving the control accuracy by full display of the learning effect.

BRIEF DESCRIPTION OF THE DRAWINGS

The present invention will be apparent from the following detailed description taken in conjunction with the accompanying drawings, in which.

DETAILED DESCRIPTION OF THE PREFERRED EMBODIMENTS

Figure 1:
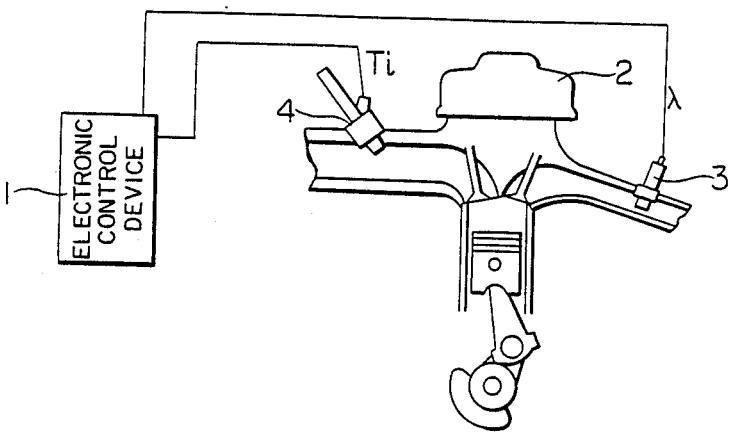
FIG. 1 (PRIOR ART)
FIG. 1 is a schematic diagram showing an example of an engine control system of air-fuel ratio feedback control type.

An air-fuel ratio control method according to the present invention will be explained in detail below with reference to the embodiments shown in the accompanying drawings.

The hardware construction and the general operation of the fuel injection control of an embodiment of the present invention is substantially the same as those of the prior art system explained with reference to FIG. 1. The embodiment, however, is different from the prior art in part of a specific control system, and also in part of the control operation of a microcomputer system incorporated in the electronic control system 1 shown in FIG. 1.

The present embodiment will be explained below with emphasis placed on these differences.

In the description that follows, a regional compensation factor Kr will be expressed as Kl (hereinafter referred to as the learning factor) in order to stress the fact that the factor Kr is obtained as a result of learning compensation.

In this embodiment, therefore, the injection time Ti of the injector 4 is expressed by equation (4) below instead of by equation (3).

$$Ti = K \cdot Tp \cdot \alpha Kl \cdot \Sigma Ki \quad (4)$$

Let the output signal of the oxygen sensor 3 be λ. This signal λ is produced in digital form (taking a high-level or low-level value alone) according to the presence or absence of oxygen in the exhaust gas. In order to permit an air-fuel ratio control on the basis of the digital signal, the output signal λ of the oxygen sensor 3 is checked, and the control factor α is changed stepwise upward or downward each time the output signal λ changes from high (air-fuel ratio on rich side) to low level (air-fuel ratio on lean side) or from low level to high level, followed by gradual increase or decrease thereof.

Figure 2:
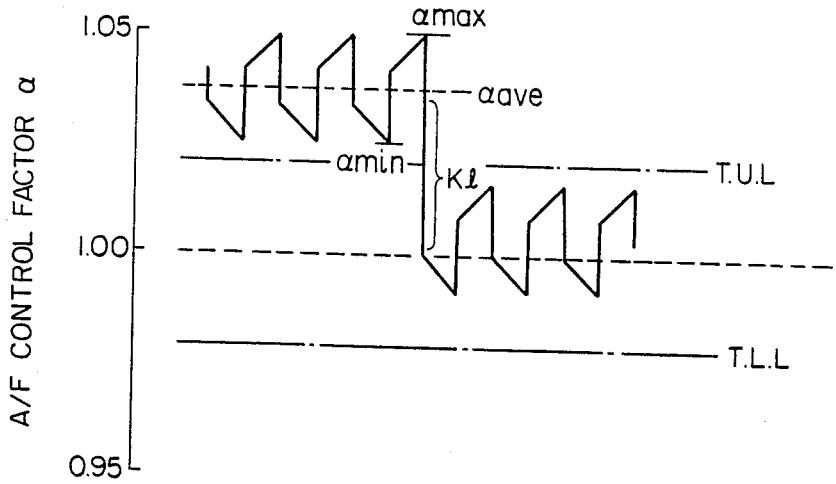
FIG. 2 is a diagram for explaining the operation of an embodiment of the present invention.

The manner of change in the control factor α according to the rich or lean state of the signal λ is shown in FIG. 2.

An extreme value of the control factor α which appears at the time of reversal of the output signal λ of the oxygen sensor 3 is checked, so that the extreme value obtained at the time of change from lean to rich state of air-fuel mixture gas is assumed to be $\alpha_{max}$, and the extreme value obtained at the time of change from rich to lean state is assumed to be $o_{min}$. From these values, the average value $\alpha_{ave}$ of the factor α is obtained by the equation below.

$$\alpha_{ave} = \frac{\alpha_{max} + \alpha_{min}}{2} \quad (5)$$

The concept of the average value $\alpha_{ave}$ is well known by the Japanese Patent Laid-Open No. 26229/82, for example.

In an embodiment of the present invention, an upper limit T.U.L and a lower limit T.L.L of this average value $a_{ave}$ are set as shown in FIG. 2, and when the average value $\alpha_{ave}$ deviates from the range between T.U.L and T.L.L, the error between the average value $\alpha_{ave}$ and $\alpha = 1.0$ is taken out and used as a learning factor Kl. The process of taking out this learning factor Kl is performed in all engine operating regions subjected to oxygen feedback control.

Figure 3:
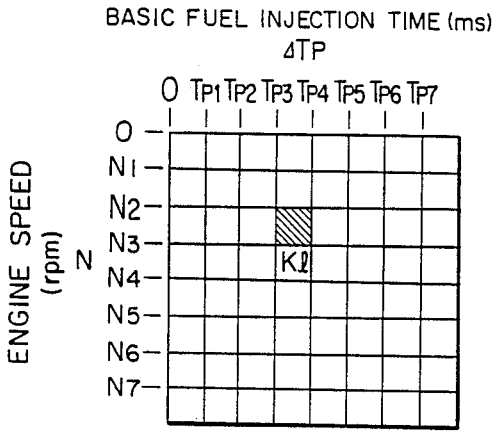
FIG. 3 is a diagram showing an embodiment of the steady-state learning map used in the present invention.

FIG. 3 shows an example of the memory map for writing the learning factor Kl, in which the engine operating regions are determined by the engine speed N and the basic fuel injection time Tp, and each learning factor Kl determined as above is stored therein according to each operating region.

The learning factor Kl is picked up only when and on condition that at least n extreme values of the control factor α (n: a predetermined value such as 5) have appeared continuously while the engine operating conditions remain in the same operating region.

The map of FIG. 3, which is used to store the learning factor Kl used for controlling the fuel injection time Ti steadily according to equation (4), is defined as a steady-state learning map.

Figure 4:
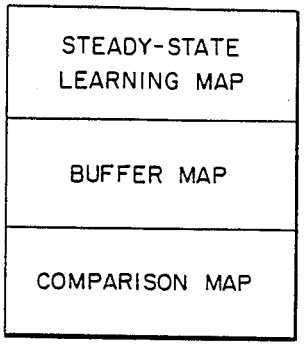
FIG. 4 is a diagram showing the concept of a map combination according to the present invention.

As seen from the map of FIG. 3, according to the present embodiment, the basic fuel injection time Tp, which corresponds to engine load as apparent from equation (2), is divided into eight parts from 0 to Tp7, and the engine speed is also divided from 0 to $N_7$, so that a total of $64(=8\times8)$ dividing points are obtained and used as engine operating regions. In this embodiment, the learning factors Kl are not directly written or corrected in the steady-state learning map but make use of another two maps including a buffer map and a comparison map as shown in FIG. 4 having the same regional configuration as the steady-state learning map.

A routine for preparation of a steady-state learning map using a plurality of maps as above will be explained with reference to FIG. 5.

Figure 5:
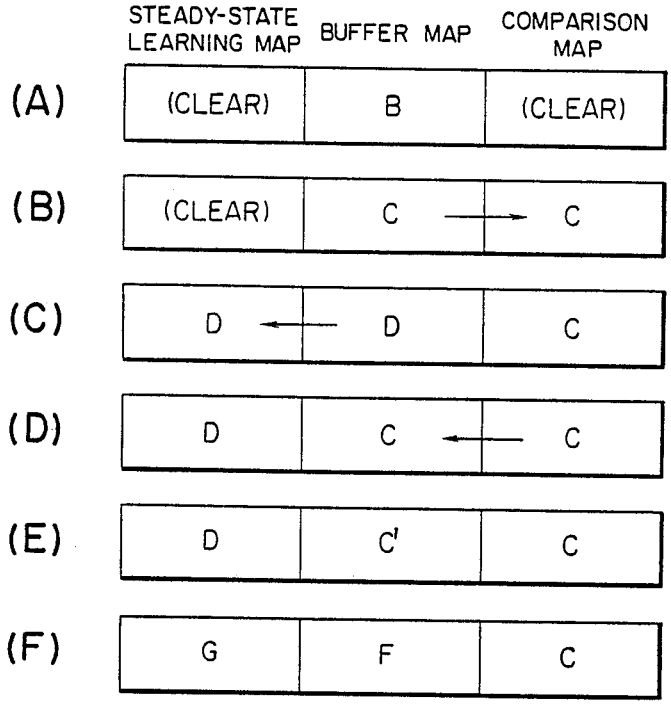
FIG. 5 is a diagram for explaining the map-drawing operation according to the present invention.

Initially, the steady-state learning map and the comparison map are both cleared as shown in FIG. 5 (A). When the engine is operated under this condition and each time the value of the learning factor Kl is determined for each operating region, it is sequentially written in a corresponding area of the buffer map alone. The routine for determining the learning factor Kl in this process will be described later. In this case, the factor Kl in equation (4) is set to 1.0.

The number of the operating regions in which the learning factor Kl is written in the buffer map is increased as the engine continues to be operated. The learning factors Kl for all the 64 operating regions provided in the map, however, cannot be determined easily by normal engine operation since the operating regions include sufficient margins over actual engine operation.

When the number C of the operating regions where the learning factor Kl is written in the buffer map under the condition of FIG. 5 (A) reaches a predetermined value l, therefore, the same data of number C written in the buffer map is also written in the comparison map as shown in FIG. 5 (B). The value l is smaller than the number 64 of the operating regions provided in these maps, and is set to the range from 20 to 30 in this case.

Next, as shown in FIG. 5 (C), with reference to the data in the number of C written in the buffer map, predetermined learning factor Kl is written in all the operating regions to complete the whole buffer map. This state is expressed by D in the drawing. This data D is transferred to the steady-state learning map, followed by transfer to the buffer map of the data C which has thus far been stored in the comparison map as shown in FIG. 5 (D).

As a result, all the regions of the steady-state learning map have stored therein the learning factor Kl, so that the fuel injection time Ti begins to be controlled according to equation (4) using the learning factor Kl of the steady-state learning map at the time point when the condition of FIG. 5 (D) is obtained. Up to this time, the calculation of equation (4) is conducted with the constant 1.0 as the learning factor Kl.

After the engine control has been entered with the steady-state learning map in this manner, the learning factors Kl in the steady-state learning map and the buffer map are corrected by a new factor as shown in FIG. 5 (E) each time a new learning factor Kl is obtained by the learning in a corresponding operating region as shown in FIG. 2, thus changing the data D and C to D′ and C′ respectively. Each time the correction is made by the new factor (in the case of the buffer map, not only the correction but also the new writing in the operating regions that have not thus far written with any learning factor), the control factor α is temporarily made 1.0, and the data C' written in the buffer map is compared with the data C stored in the comparison map to check to see whether or not the difference in the number of factors in respective regions reaches a predetermined number m. If it has reached the number m, the data F of the buffer map of FIG. 5 (F) is transferred to the comparison map as shown in FIG. 5 (B). Then, as shown in FIG. 5 (C), on the basis of the value of the data in the regions already corrected, the factors of all the regions are corrected and written in the steady-state learning map. The routine of FIGS. 5 (B) to 5 (D) is repeated. In other words, FIG. 5 (F) indicates the processes from (B) to (D) sequentially conducted. The number m mentioned above is a predetermined value such as 10 smaller than number l.

According to this embodiment, the air-fuel ratio can be controlled while maintaining the average value of the control factor $\alpha$ always near 1.0 by the learning factor Kl, resulting in a high responsiveness to fully prevent the exhaust gas from deteriorating during the transient state. In addition, the decision of the time point where the steady-state learning map is to be rewritten by learning is very rationally made by comparison between the buffer map and the comparison map, so that the learning becomes possible accurately meeting the variation of the characteristics of the parts due to aging, thus keeping the exhaust gas characteristic uniform over a long period of time.

According to the present embodiment, in the regions of the steady-state learning map shown in FIG. 3 where the basic fuel injection time Tp is Tp7 or more and the engine speed N is $N_7$ or more, the learning factor Kl in the regions in the column to the extreme right in the lowest line of the map is used for control, and therefore an optimum power correction is automatically effected all the time even when the engine operating conditions enter the power running area.

Figure 6:
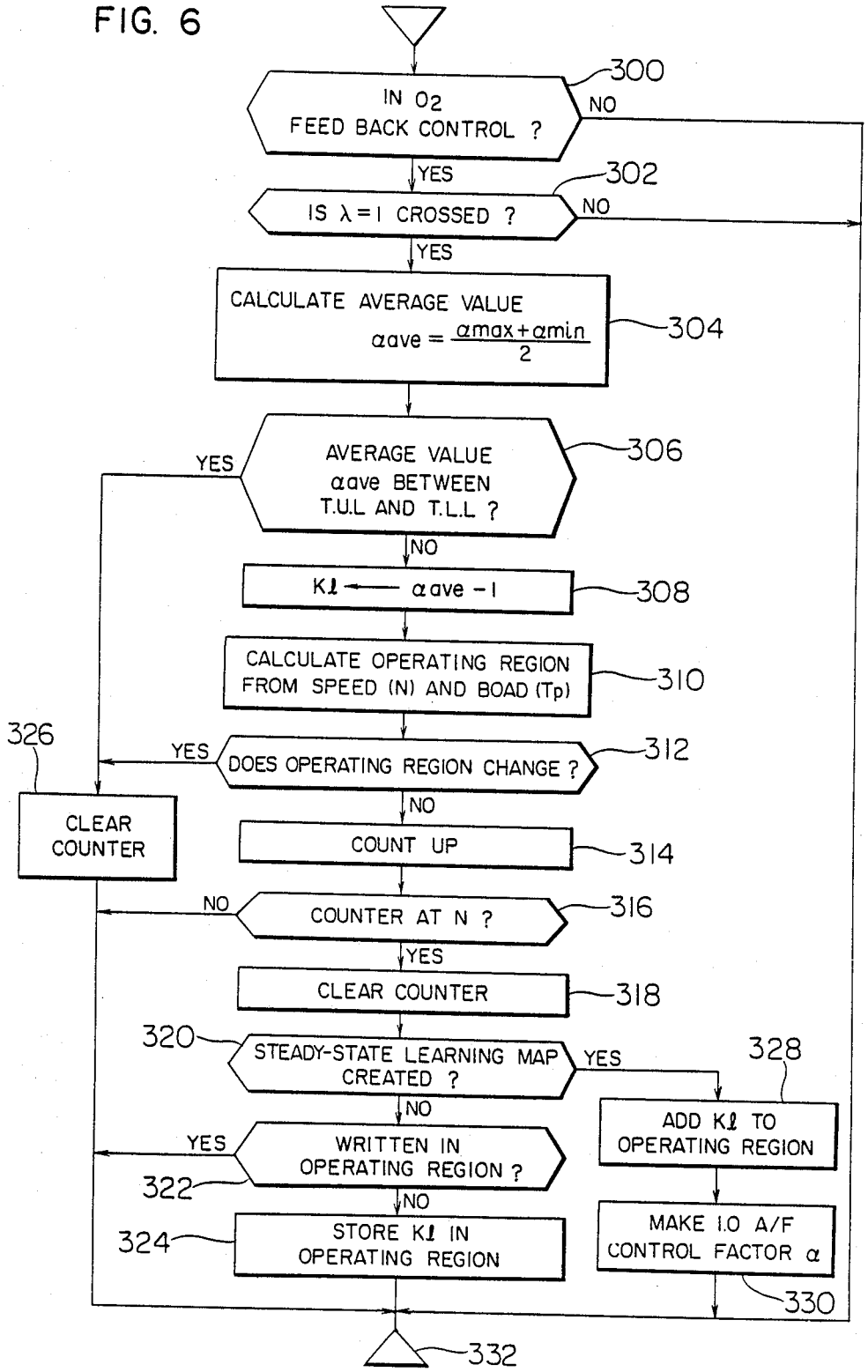
FIGS. 6 and 7 are flowcharts indicating map-drawing processes.
Figure 7:
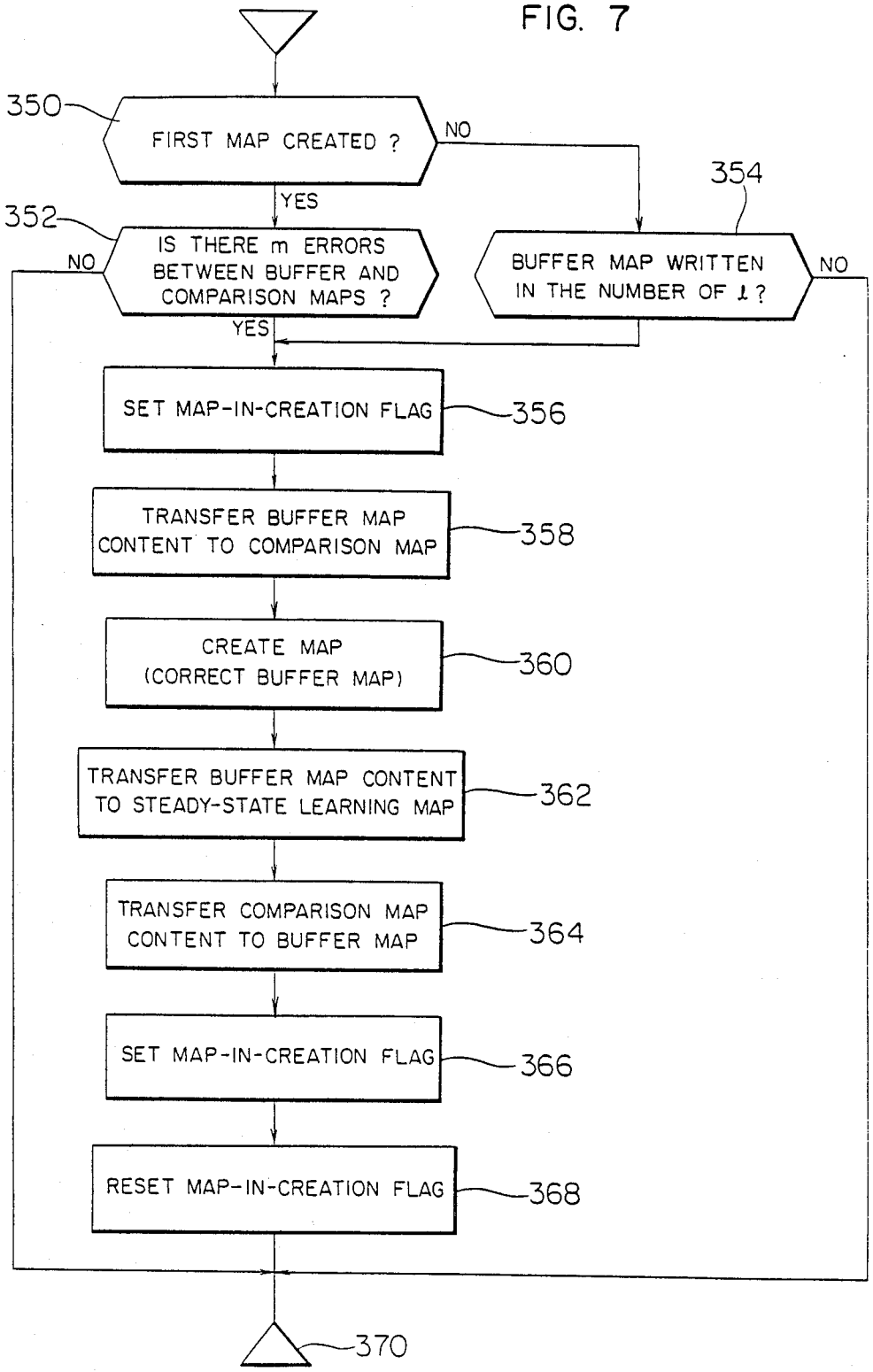

Now, an embodiment of the learning routine of the learning factor Kl and the routine for executing the process shown in FIG. 5 will be explained with reference to the flowcharts of FIGS. 6 and 7.

The process according to these flowcharts is repeated at regular intervals of time such as 40 msec after engine start. First, in FIG. 6, step 300 decides whether or not the oxygen feedback control has been started, and if the result is "Yes", the process is passed to step 302. If the answer is "No", by contrast, the process proceeds to step 332. At step 302, whether or not the signal of the oxygen sensor has crossed the level of $\lambda=1$ (air-fuel ratio A/F of 14.7). If the answer is "No", the process is passed to step 332 where the well-known integrating process is performed (the process for determining the change in the incrementing and decrementing portions of the control factor $\alpha$). If the result is "Yes", the process is passed to step 304, where the average value $\alpha_{ave}$ shown in equation (3) is calculated. Step 306 decides whether or not the average value $\alpha_{ave}$ is included in the range between upper and lower limits shown in FIG. 2, and if it is included, it indicates that normal feedback control is effected so that the counter is cleared at step 326 and the process is passed to step 332.

If the average value $\alpha_{ave}$ is not included in the range between upper and lower limits, by contrast, the error between the average value $\alpha_{ave}$ and unity is determined as a learning compensation amount Kl at step 308. Then, step 310 calculates the present operating region determined from the basic fuel injection time Tp and the engine speed N shown in FIG. 3, followed by step 312 where it is compared with the immediately preceding operating region of the routine to decide whether or not the operating region has undergone a change. If it is found that the operating region has changed, that is, when the answer is "Yes", an operating region is not determined where the learning compensation amount Kl is to be written, and therefore the process is passed to step 326. If the operating region remains unchanged, on the other hand, the counter is counted up at step 314, followed by step 316 to decide whether or not the counter has reached n. If the count is not n, that is, when the answer is "No", the process proceeds to step 332. If the count is found to have reached n, by contrast, that is, when the answer is "Yes", step 318 clears the counter, and the process is passed to step 320.

Step 320 decides whether or not the first steady-state learning map has been prepared by the operation from (B) to (D) in FIG. 5. If the map is not yet prepared, the process proceeds to step 322 and so on to perform the operation of (A) explained with reference to FIG. 5. Step 322 decides whether or not the factor Kl has already been written in the operating region involved. If it is already written, that is, when the answer is "Yes", the process is passed to step 332 without any further process. If the result is "No", on the other hand, step 324 writes the learning compensation amount Kl calculated at step 308 in the operating region involved. If it is found that the first steady-state learning map has been prepared, or the answer is "Yes" at step 320, then the process is passed to step 328 and so on to perform the operation of (E) and (F) explained with reference to FIG. 5. Step 328 adds the learning compensation amount Kl to the dividing point of the steady-state learning map and the buffer map, followed by step 330 where the air-fuel ratio compensation factor is made 1.0.

By repeating the processes according to steps 300 to 332, the operations (A), (E) and (F) described with reference to FIG. 5 are performed.

Now, the operations of (B), (C) and (D) explained with reference to FIG. 5 will be described with reference to the flowchart of FIG. 7.

Step 350 decides whether or not the first steady-state learning map has been prepared and if it has not yet been prepared, that is, when the answer is "No", the process is passed to step 354 to check the number of regions written of the buffer map. If the number has reached l, the process is passed to step 356, while the process proceeds to step 370 in the opposite case. If the first steady-state learning map is found to have been prepared that is, when the answer is "Yes" at step 350, step 352 checks the difference between the data on the buffer map and the comparison map. If there is a difference of m between the data between buffer map and comparison map, the process proceeds to step 356 to prepare a steady-state learning map. If the data difference is less than m, by contrast, the process is passed to step 370.

At step 356, the flag in the process of preparing a map is set to prohibit the writing of the learning result. Step 358 transfers the data in the buffer map to the comparison map, followed by step 360 where the steady state map is prepared by use of the buffer map. Step 362 transfers the data of the buffer map thus prepared to the steady-state learning map, followed by step 364 where the data of the comparison map is transferred to the buffer map. Step 366 sets the flag meaning that the steady-state learning map has been prepared. This flag is used for decision at step 350 and step 320 in FIG. 6. Step 368 resets the flag indicating the process of map preparation set at step 356.

Figure 8:
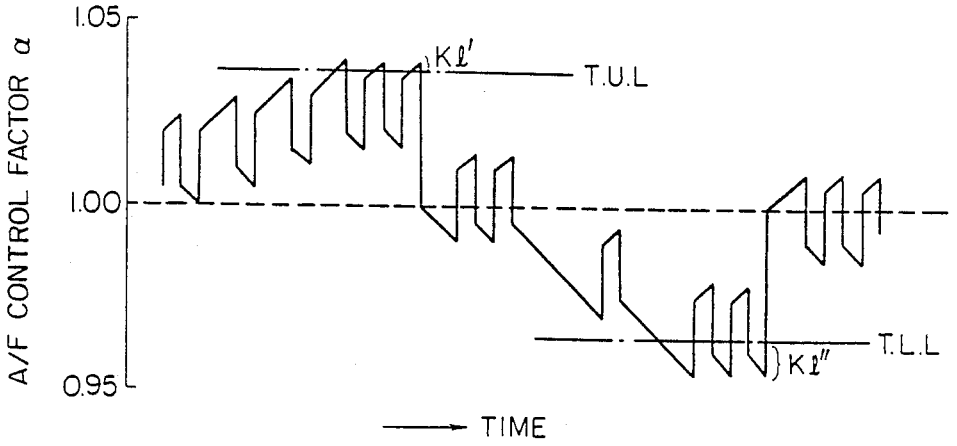
FIG. 8 is a diagram for explaining the operation of another embodiment of the present invention.
Figure 9:
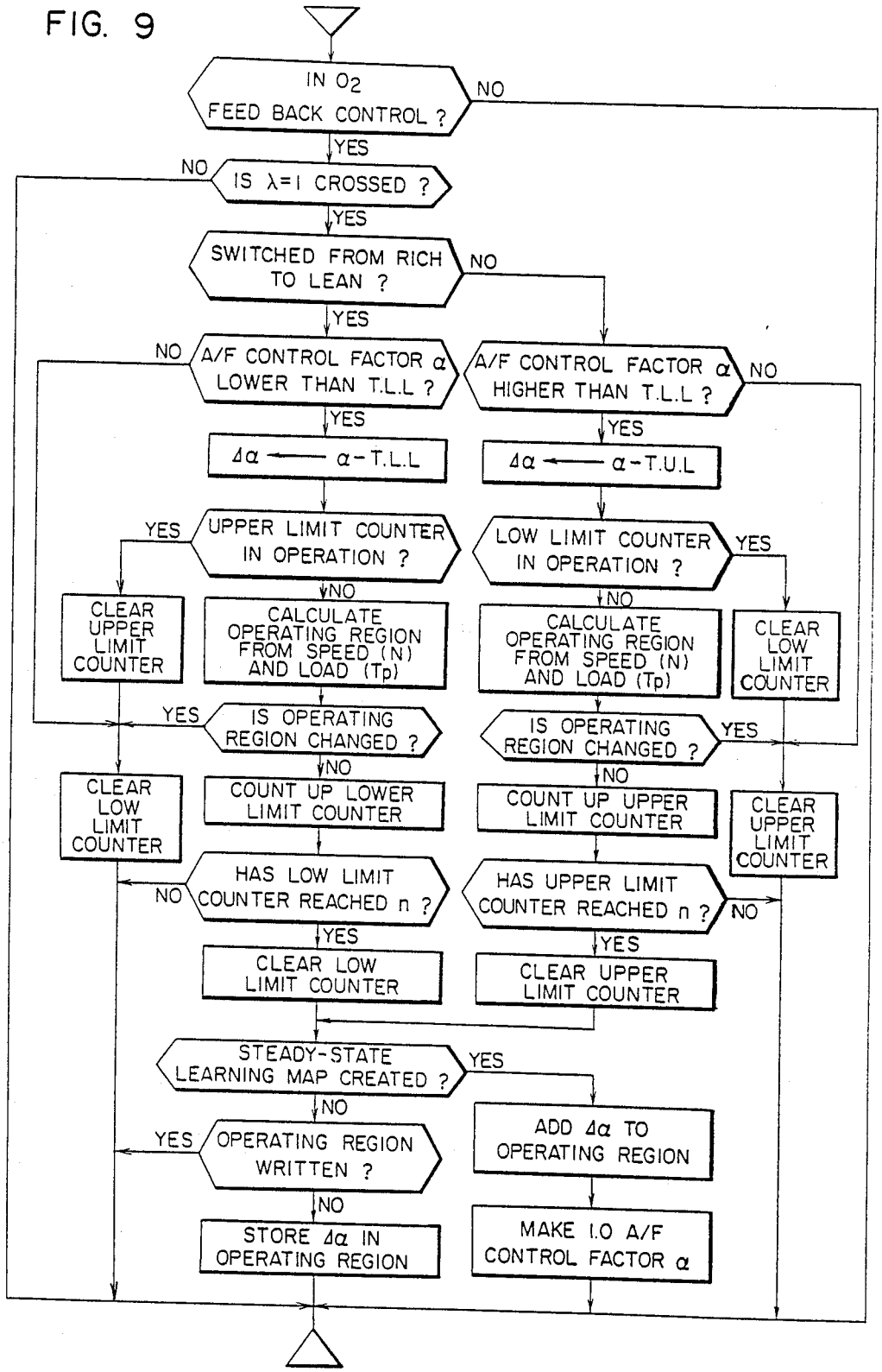
FIG. 9 is a flowchart for explaining the operation of the same embodiment.
Figure 11:
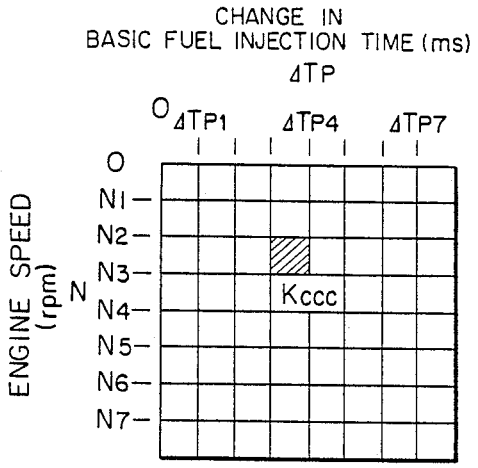
FIGS. 11 and 12 are diagrams showing the map concept of the same embodiment.
Figure 12:
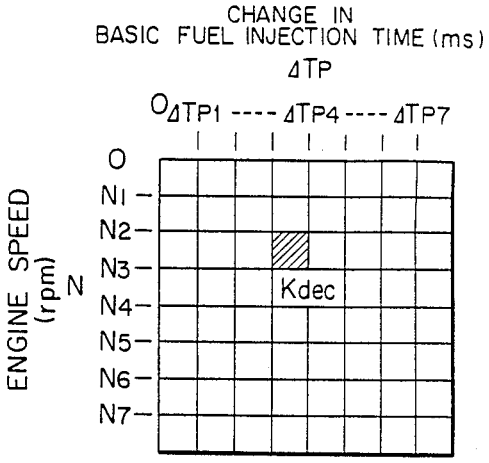

The operation of another embodiment of the present invention is shown in FIG. 8. The difference of this embodiment from that of FIG. 2 in that a learning factor is calculated when the instantaneous value, but not the average value, of the air-fuel ratio control factor $\alpha$ has exceeded the upper limit (T.U.L) or lower limit (T.L.L). The excess Kl' of the control factor $\alpha$ above T.U.L or the excess thereof Kl'' below T.L.L is expressed as $\Delta\alpha$, which is considered a learning factor Kl. This process is conducted as shown in the flowchart of FIG. 9.

In the embodiments described above, all the learning factors Kl written in the steady-state learning map are not more than those that can be so written. When the change in the characteristic of the parts increased to a certain degree, however, the learning factor Kl for correcting them also increases and may exceed a critical value that can be written. In view of this, it is possible to take such a measure that when even one of the learning factors Kl has exceeded the critical value, a certain number is added to or reduced from all the regions of the map, so that the average value for the whole map approaches 1.0 while the number so added or reduced is included in the factor K of equation (4). In this way, the values for the whole map can be shifted, whereby a large secular variation can be fully absorbed for sufficient compensation.

Now, another embodiment of the present invention will be explained with reference to FIGS. 10 to 13.

Figure 10A:
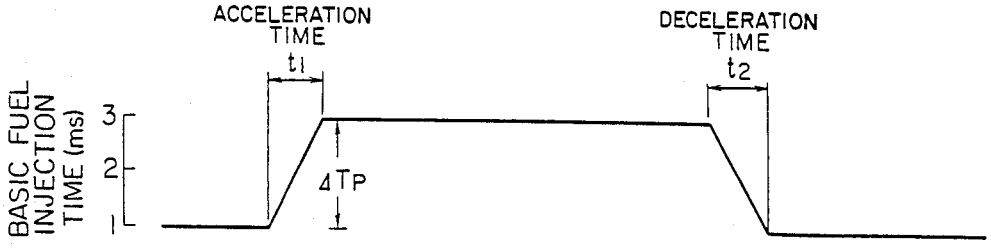
FIGS. 10A and 10B are diagrams for explaining the operation of still another embodiment of the present invention.
Figure 10B:
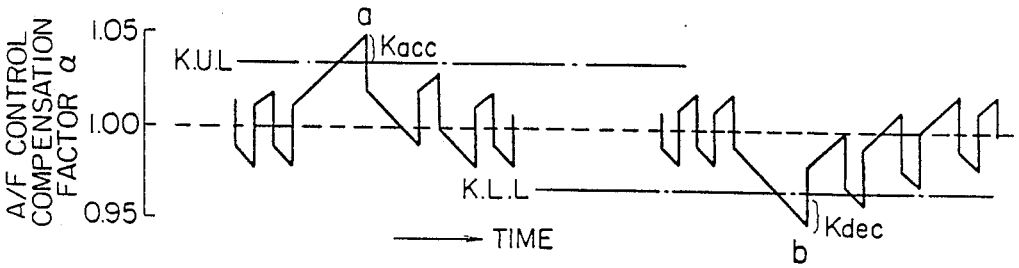

In this embodiment, an independent compensation factor in addition to the learning factor Kl is used in a large transient control conditions with the engine accelerated or decelerated. First, as shown in FIG. 10A, the transient condition of the engine such as when it is accelerated or decelerated is known by the change rate $\Delta Tp$ per unit time of the basic fuel injection time Tp. During this acceleration period $t_1$ or deceleration period $t_2$, the air-fuel ratio control factor $\alpha$ takes an extreme value a or b as shown in FIG. 10B.

When this extreme value a or b exceeds a predetermined upper limit (K.U.L) or reduced below a predetermined lower limit (K.L.L), the error Kacc or Kdec between such a limit and the actual value of a or b, as the case may be, is determined, and is regarded as an acceleration learning compensation amount Kacc or the deceleration learning compensation amount Kdec respectively. They are then written at corresponding operating regions of an acceleration learning map (FIG. 11) and a deceleration learning map (FIG. 12) in which the change rate $\Delta Tp$ of the basic fuel injection time Tp is plotted along the abscissa, and the engine speed N is plotted along the ordinate as in the above steady-state learning map.

At the same time, according to this embodiment, the injection time Ti of the injector 3 is calculated and controlled by the equation below.

$$Ti = K \cdot Tp \cdot \alpha \cdot (Kl + Kt) \cdot \Sigma Ki \qquad (5')$$

where Kt is a transient learning factor which is represented by the acceleration learning compensation amount Kacc read out of the corresponding operating region of the acceleration learning map when the transient condition involves acceleration, and by the deceleration learning compensation amount Kdec read out of the corresponding operating region of the deceleration learning map when the transient condition concerns deceleration.

According to the embodiment under consideration, therefore, when the engine operating condition is undergoing a comparatively slow change, an appropriate control is effected for each operating region by the learning factor Kl read from the corresponding operating region of the steady-state learning map as in the embodiment described with reference to up to FIG. 9, while when the engine enters a transient state, the control by the learning factor Kl is added, and depending on the transient condition, a more detailed control is effected by the acceleration learning compensation amount Kacc or the deceleration learning compensation amount Kdec read out of the transient operating regions of the acceleration learning map or the deceleration learning map respectively. Under any operating condition, it is thus possible to perform proper air-fuel ratio control, thus keeping the exhaust gas always in the best condition.

Figure 13:
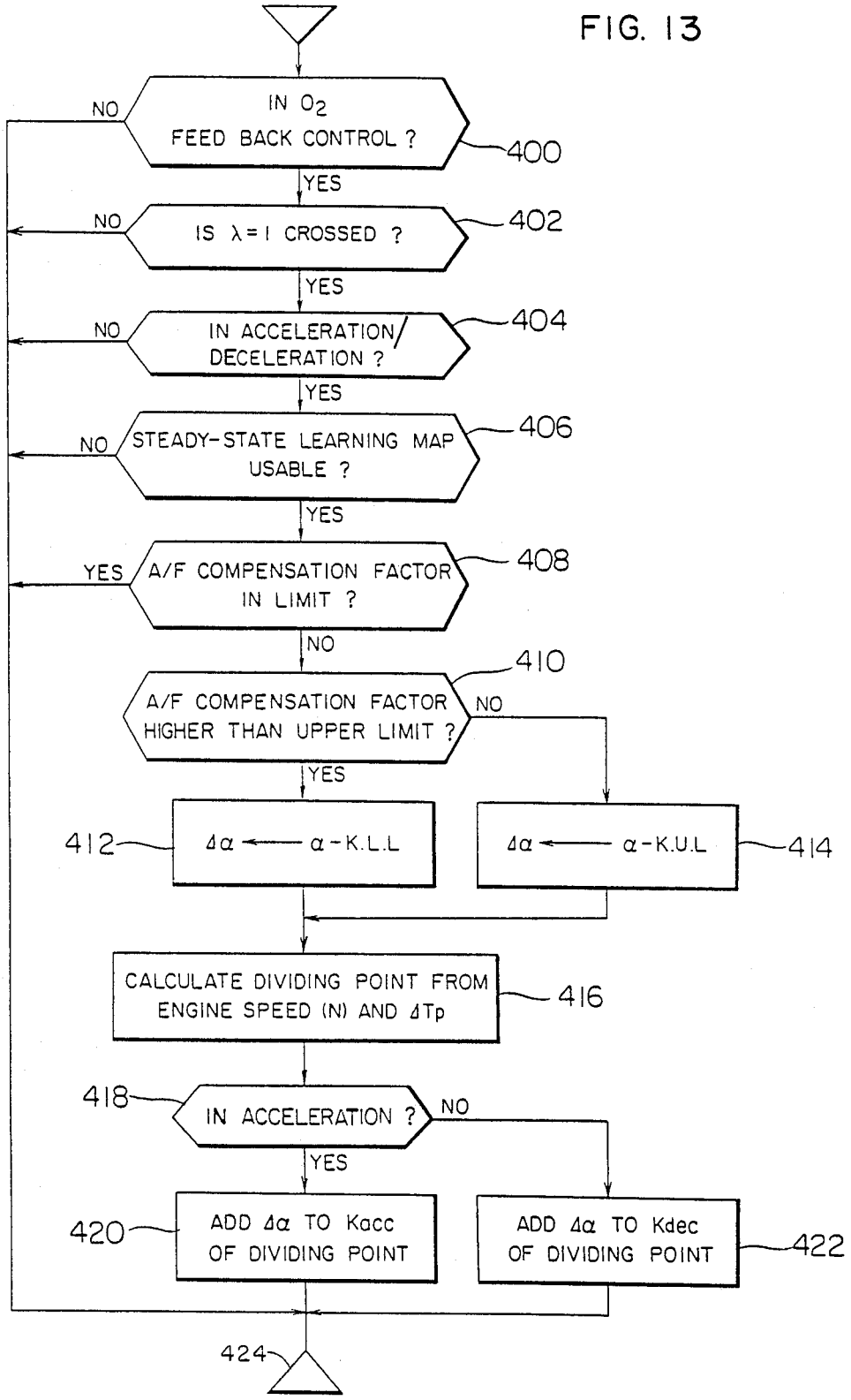
FIG. 13 is a flowchart for explaining the operation of the same embodiment.

Now, an example of the learning routine of the acceleration learning compensation amount Kacc and the deceleration learning compensation amount Kdec in this embodiment will be explained below with reference to the flowchart of FIG. 13.

Step 400 decides whether or not the engine is under oxygen feedback control. If not, the process is passed to step 424. If the engine is under oxygen feedback control, on the other hand, the process proceeds to the step 402 to check to see whether or not the output of the oxygen sensor has reversed. If it has just reversed, the process is passed to step 404. If not, by contrast, step 424 is followed. Step 404 checks the acceleration or deceleration. For checking the acceleration or deceleration, a method is to determine the change of the basic fuel injection time Tp during a certain period of time. If the acceleration or deceleration is not involved, the process is passed to step 424. If the opposite is the case, the process proceeds to step 406.

Step 406 decides whether or not a steady-state learning map is created and is used, and if it is not yet created, the process is passed to step 424. If the steady-state learning map is usable, by contrast, the process proceeds to step 408. Step 408 decides whether or not the air-fuel ratio control factor $\alpha$ is included in the range between the upper and lower limits indicated in FIG. 10B. If it is included in the range, the process is passed to step 424. If the answer is "No", on the other hand, step 410 is followed. Step 410 decides whether the air-fuel ratio control factor $\alpha$ is larger than the upper limit (K.U.L), and if so, the process is passed to step 412, while if not, the process proceeds to step 414, to calculated the learning compensation amount $\Delta\alpha$ for acceleration or deceleration respectively. The next step 416 calculates an operating region from the engine speed N and the basic fuel injection time change range $\Delta Tp$ at the time point of acceleration or deceleration detection. Step 418 decides whether an acceleration or deceleration is involved at the time of detection of acceleration or deceleration respectively, and if an acceleration is involved, step 420 adds the acceleration learning compensation amount $\Delta\alpha$ to the acceleration learning map, while if a deceleration is involved, the deceleration learning compensation amount $\Delta\alpha$ is added to the deceleration learning map at step 422.

The acceleration or deceleration learning compensation amount is not limited to Kacc or Kdec as shown in FIG. 10B. Instead, if it is taken as an error from 1.0, division into steps 412 and 414 is not necessary, but the equation below may be used to obtain the learning compensation amount.

$$\Delta\alpha=\alpha-1 \quad (6)$$

The change rate ΔTp of the basic fuel injection time may also be replaced with the change in intake negative pressure or change in throttle opening, or change in the intake air flow rate. In this case, it is apparent to incorporate the engine speed and intake negative pressure for learning map (FIGS. 11 and 12) of the acceleration and deceleration.

As explained above, according to the present invention, the learning factor can be calculated, and the map storing it can be rationally created and corrected, so that the advantage of the learning control system is fully utilized. As a result, even when the characteristics of the various actuators and sensor necessary for the air-fuel ratio control are subjected to variations, secular or otherwise, the operating conditions are always capable of being corrected automatically thereby to keep the exhaust gas in satisfactory condition.

Further, according to the present invention, the correction by the steady-state learning map is effected even in the power region where the air-fuel ratio feedback control is not effected, and therefore it is possible to prevent the effect of the characteristics or secular variations of the actuators and sensors thereby to permit an optimum power correction even in the power region.

Figure 14:
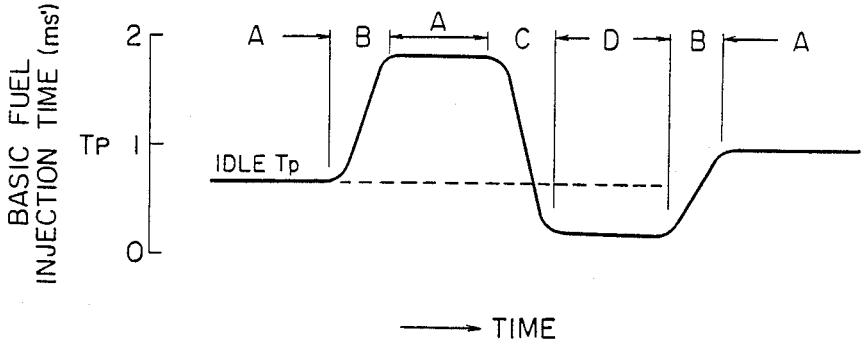
FIG. 14 is a diagram for explaining the transient learning operation according to an embodiment of the present invention.

FIG. 14 shows the relation between the basic fuel injection time and various corrections according to the embodiment under consideration. Character A designates a steady-state learning region, B an acceleration learning region, and C a deceleration learning region. Character D designates a region which is effected by the shift factor Ks given by equation (6) below.

According to an embodiment of the present invention, the fuel injection time Ti is determined as shown below.

$$Ti=\alpha\cdot Tp\cdot(Kl+Kt-Ks)\cdot(1+\Sigma Ki) \quad (7)$$

$$Tp=k\cdot Q_A/N \quad (8)$$

where k: A factor determined by the injector
Tp: A basic fuel injection time
α: Air-fuel ratio compensation factor
Kl: Steady-state learning factor
Kt: Transient learning factor
Ki: Various compensation factors
Ks: Shift factor
$Q_A$: Intake air flow rate
N: Engine speed Specifically, the basic fuel injection time Tp is determined according to equation (2) from the engine intake air flow rate $Q_A$ and the engine speed N thereby to obtain a rough stoichiometric air-fuel ratio (A/F=14.7), and then the air-fuel ratio is corrected by feedback by changing the air-fuel ratio compensation factor α according to the signal λ of the oxygen sensor 142 thereby to obtain a more accurate stoichiometric air-fuel ratio. In addition, the steady-state learning factor Kl is used to compensate for the characteristics and secular variations of the various actuators and sensors used for the air-fuel ratio control. This compensation is further supplemented by the compensation due to the acceleration or deceleration, from which the shift factor is subtracted at the time of sudden deceleration thereby to determine the fuel injection time Ti.

Figure 15:
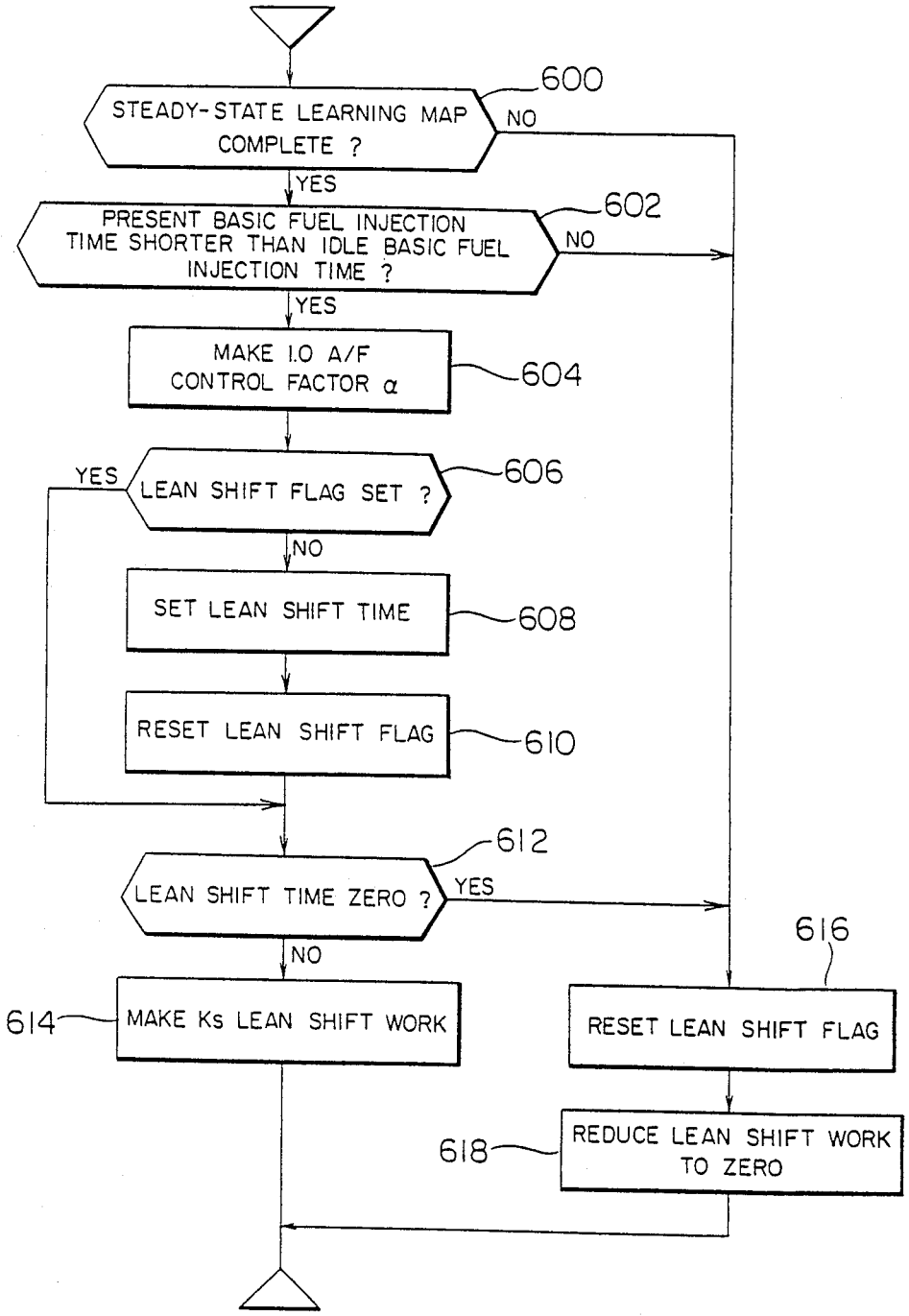
FIG. 15 is a flowchart representing the control operation using a shift factor according to another embodiment of the present invention.

A flowchart relating to this shift factor Ks is shown in FIG. 15. Step 600 checks to see whether or not the steady-state learning map has been completed by the map creation flag set at step 366 in FIG. 7. If the map is complete, the process is passed to step 602, while if the map is incomplete, the process is advanced to step 616. The process is passed from step 602 to step 604 if the present basic fuel injection time is shorter than the basic fuel injection time for idle operation thereby to make the air-fuel ratio compensation factor o unity. Step 606 checks the set state of the learn shift flag, and if it is found not set, step 608 sets the time for shifting to lean state, followed by step 610 to set the lean shift flag. Step 612 checks to see whether or not the time set at step 608 is reduced to zero, and if not, step 614 makes the lean shift work Ks. By so doing, the mixture becomes thinner by Ks during the lean shift period D when the basic fuel injection time is shorter than the idle basic fuel injection time (FIG. 14).

Step 616 resets the lean shift flag, followed by step 618 to reduce the lean shift work to zero. The updating of the lean shift time is made by separate task (not shown).

According to the embodiment of FIG. 15, only when the basic fuel injection time Tp is shorter than the idle basic fuel injection time (idle Tp), the shift factor Ks works thereby to further reduce the injection time Ti by equation (1). As a result, the air-fuel ratio is prevented from being sharply reduced to rich state which otherwise might be caused by the fuel attached on the wall of the intake manifold being absorbed into the cylinder in great amount at the time of sudden deceleration, thereby keeping the obnoxious components of the exhaust gas within the specified limit.

The magnitude of the shift factor Ks may take a value proportional to the change in the basic fuel injection time associated with sudden deceleration or the air-fuel ratio compensation factor.

In the case where the air-fuel ratio feedback control is employed without any learning control, it is possible to remove the obnoxious components of the exhaust gas even by setting a shift factor with the air-fuel ratio compensation factor fixed to the present value at the time of sudden deceleration.

Instead of using the basic fuel injection time for deciding whether a sudden deceleration is involved or not, the negative pressure value in the intake manifold or throttle angle may be divided by the engine speed to make similar decision.

Figure 16:
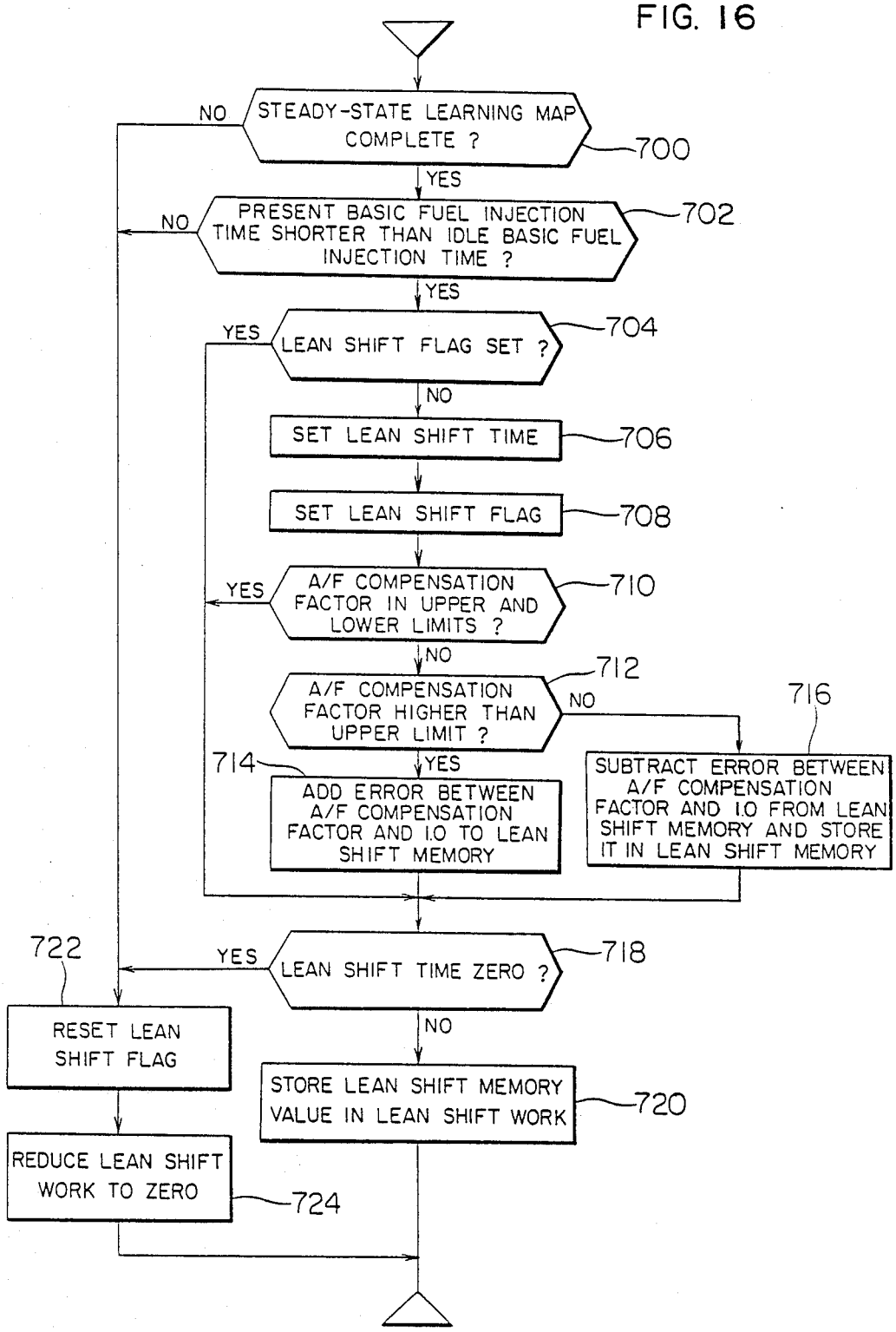
FIG. 16 is a flowchart representing the learning operation using a shift factor according to an embodiment of the present invention.

FIG. 16 is a flowchart for determining the shift factor Ks by the learning during sudden deceleration. Steps 700 and 702 are the same processes as steps 60 and 602 in FIG. 15 respectively. Step 704 checks the setting of the lean shift flag, and if it is found not set, step 706 sets the lean shift time, followed by step 708 to set the lean shift flag. Step 710 checks to see whether the air-fuel ratio compensation factor is included in the range between the upper and lower limits, and if it is found between them, the process is passed to step 718. If the air-fuel ratio compensation factor is not found out of the range between the upper and lower limits, on the other hand, the process proceeds to step 712. Then, if the air-fuel ratio compensation factor is more than the upper limit, step 714 is followed, while if it is below the lower limit thereof, the process is passed to step 716.

Step 714 adds the error of the air-fuel ratio compensation factor from 1.0 to the lean shift memory, while step 716 subtracts such an error from the lean shift memory and stores the result in the lean shift memory. If step 718 finds that the lean shift time is not zero, step 720 stores the value of the lean shift memory calculated at steps 714 and 716 in the lean shift work. Step 722 resets the lean shift flag set at step 708, followed by step 724 to reduce the lean shift work to zero.

In this way, the compensation can be effected by the shift factor Ks determined by the learning at the time of sudden deceleration.

For calculation of the fuel injection time, the lean shift work may be referred to.

As a result, according to the present embodiment, in addition to a series of steady-state learning and transient learning for air-fuel ratio control, the compensation for sudden deceleration (compensation by use of the shift factor Ks) is effected, so that the generation of an obnoxious component in spike form in the exhaust gas at the time of abrupt deceleration is fully dampened on the one hand and the operating conditions are always corrected automatically even against the characteristics or secular variations of the actuators or sensors required for air-fuel ratio control on the other hand. As a result, not only the obnoxious components are removed from the exhaust gas but also the variations, secular or not, of the sensors and actuators are compensated for by the steady-state learning map even in the power region where air-fuel ratio is not controlled by feedback, thus easily providing an air-fuel ratio control system for an internal combustion engine which can effect optimum power compensation all the time.

Also, taking advantage of the fact that the dividing point of the steady-state learning map remains unchanged, the number of reversals of the air-fuel ratio compensation factor are counted thereby to calculate the steady-state learning compensation amount under stable condition, thus producing an accurate steady-state learning map.

After creation of the steady-state learning map, the change in the air-fuel ratio compensation factor $\alpha$ at the time of acceleration or deceleration is used as a learning compensation amount with reference to the transient learning map, so that it is possible to dampen the variations in air-fuel ratio even under transient state to remove the obnoxious components, thus improving the drivability.

The construction of FIG. 1, which is well known, will be explained specifically with reference to FIGS. 17 and 18.

Figure 17:
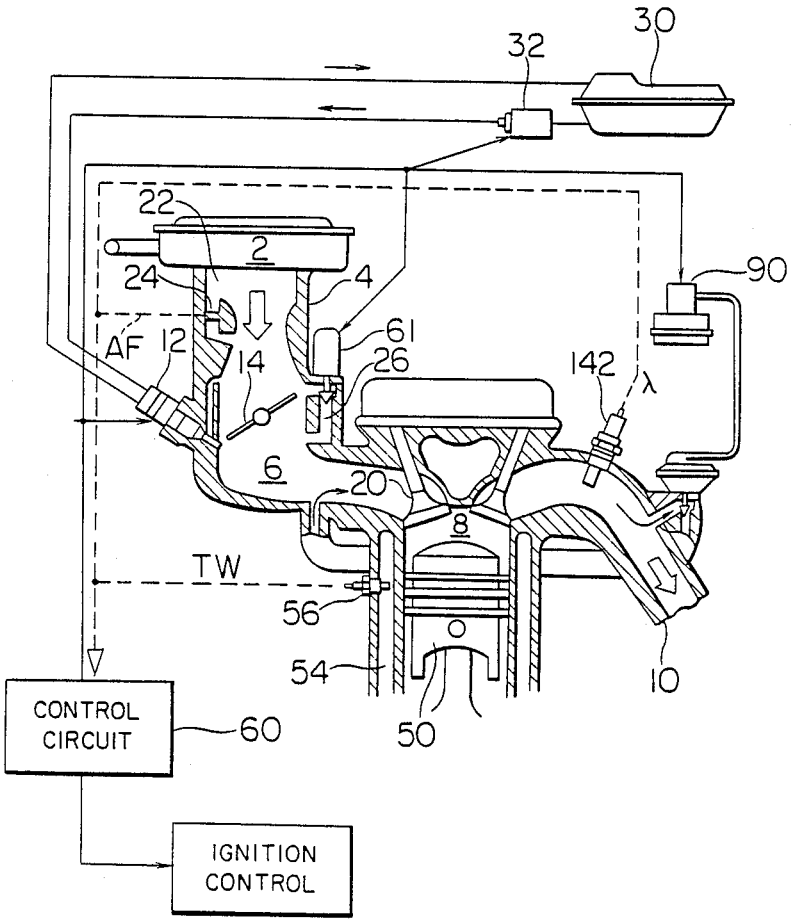
FIG. 17 (PRIOR ART)
FIG. 17 is a schematic diagram showing a construction of an electronic engine control system.

FIG. 17 is a partially cut-away sectional view of the whole of an engine control system. In FIG. 17, the intake air is supplied through an air cleaner 2, a throttle chamber 4 and an intake manifold 6 into a cylinder 8. The gas combusted in the cylinder 8 is exhausted therefrom through an exhaust manifold 10 into the atmosphere.

The throttle chamber 4 contains an injector 12 for injecting the fuel. The fuel injected from this injector 12 is atomized in the air path of the throttle chamber 4, and mixed with the intake air to make up a mixture gas, which is supplied via the intake manifold 6 to the combustion chamber of the cylinder 8 by the opening of the intake valve 20.

A throttle valve 14 is mounted near the outlet of the injector 12, which valve 14 is so constructed as to be mechanically interlocked with the accelerator pedal and driven by the driver.

An air path 22 is arranged upstream of the throttle valve 14 of the throttle chamber 4, and contains a hot-wire air flowmeter, that is, a flow rate sensor 24 made of an electrical heat resistance wire to pick up an electrical signal AF changing with the air velocity. Since the flow rate sensor 24 made of a heat resistance wire (hot wire) is arranged in the air bypass 22, it is protected from the high temperature gas generated at the time of back fire from the cylinder 8 on the one hand and from the contamination by the dust in the intake air on the other hand. The outlet of the air bypass 22 is opened to a point near the narrowest portion of the venturi, while the entrance thereof is open upstream of the venturi.

The injector 12 is supplied with the fuel pressurized through a fuel pump 32 from a fuel tank 30. Upon application of an injection signal from the control circuit 60 to the injector 12, the fuel is injected into the intake manifold 6 from the injector 12.

The mixture gas taken in by way of the intake valve 20 is compressed by the piston 50, and burnt by a spark started on the spark plug (not shown). This combustion energy is converted into kinetic energy. The cylinder 8 is cooled by the cooling water 54. The temperature of the cooling water is measured by water temperature sensor 56, and the resulting measurement TW is used as an engine temperature.

The exhaust manifold 10 has an oxygen sensor 142, which measures the oxygen in the exhaust gas and produces a measurement $\lambda$.

The crankshaft not shown carries a crank angle sensor for producing a reference angle signal and a position signal respectively for each reference crank angle and a predetermined angle (such as 0.5 degree) in accordance with the rotation of the engine.

The output of the crank angle sensor, the output signal TW of the water temperature sensor 56, the output signal $\lambda$ of the oxygen sensor 142, and the electrical signal AF from the hot wire 24 are applied to the control circuit 60 including a microcomputer and the like, an output of which drives the injector 12 and the ignition coil.

Further, a bypass 26 leading to the intake manifold 6 is arranged over the throttle valve 14 in the throttle chamber 4, and includes a bypass valve 61 controlled to open and close.

This bypass valve 61 faces the bypass 26 arrange around the throttle valve 14 and is operated by a pulse current to change the sectional area of the bypass 26 by the lift thereof. This lift drives and controls a drive unit in response to the output of the control circuit 60. Specifically, the control circuit 60 produces a periodical operation signal for controlling the drive unit, so that the drive unit adjusts the lift of the bypass valve 61 in response to this periodical operation signal.

An EGR control valve 90 is for controlling the path between the exhaust manifold 10 and the intake manifold 6 and thus to control the amount of EGR from the exhaust manifold 10 to the intake manifold 6.

In this way, the injector 12 of FIG. 1 is controlled thereby to regulate the air-fuel ratio and the fuel increment, while the engine speed is controlled in idle state (ISC) by the bypass valve 61 and the injector 12, to which is added to EGR amount control.

Figure 18:
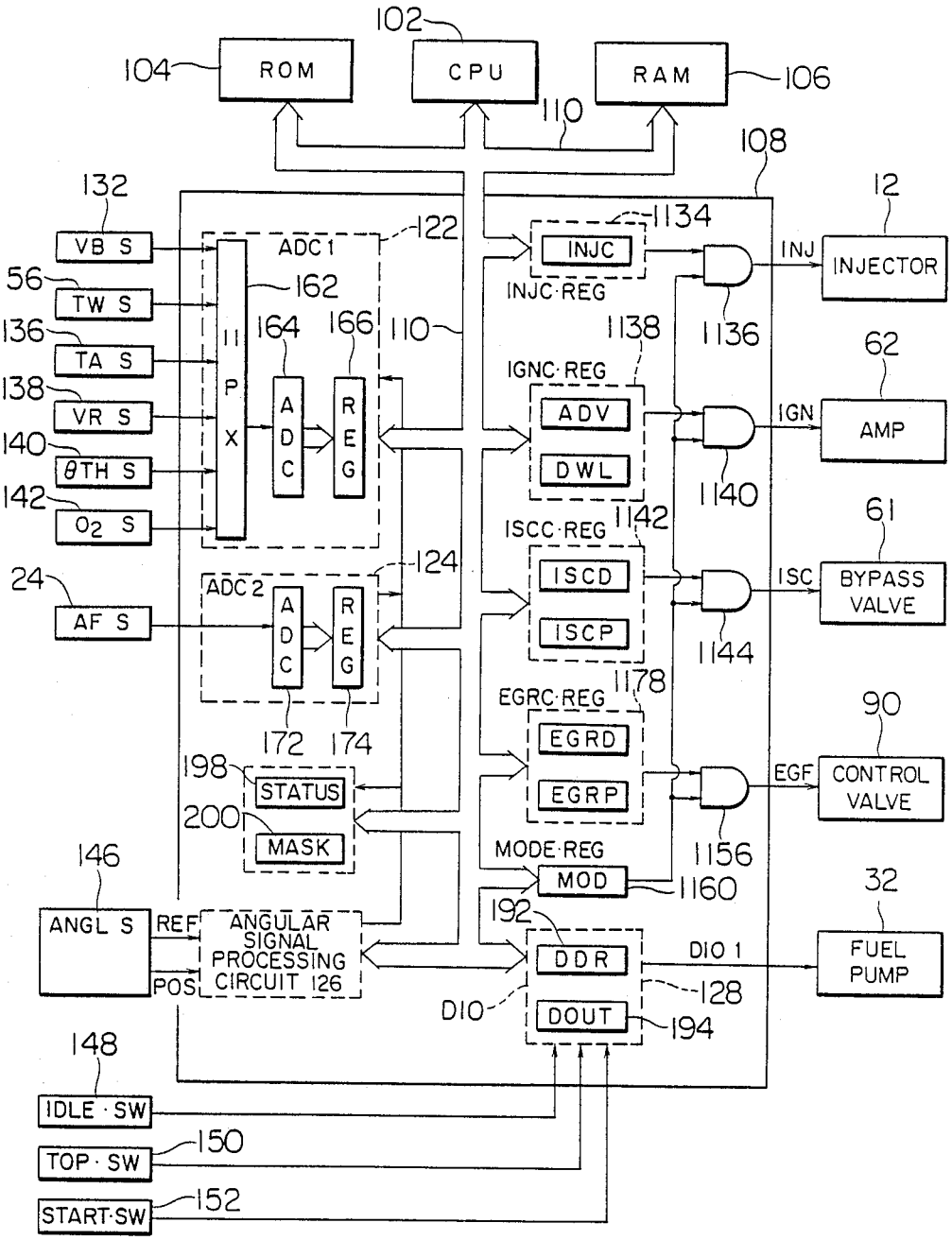
FIG. 18 (PRIOR ART)
FIG. 18 is a block diagram showing an example of a control circuit.

FIG. 18 shows the whole configuration of the control circuit 60 using a microcomputer, including a central processing unit 102 (CPU), a read only memory 104

(ROM), a random access memory 106 (RAM), and an input/output circuit 108. The CPU 102 computes the input data from the input/output circuit 108 by various programs stored in ROM 104, and returns the result of computation to the input/output circuit 108. RAM 106 is used as an intermediate storage necessary for the computation. Exchange of data between CPU 102, ROM 104, RAM 106 and the input/output circuit 108 is effected through a bus line 110 including a data bus, a control bus and an address bus.

The input/output circuit 108 includes input means such as a first analog-digital converter 122 (hereinafter called ADC1), a second analog-digital converter (hereinafter called ADC2) 124, an angular signal processing circuit 126 and a discrete input/output circuit (hereinafter called DIO) 128 for inputting and outputting a 1-bit data.

ADCl includes a multiplexer (hereinafter called MPX) 162 supplied with outputs from a battery voltage sensor (hereinafter called VBS) 132, a cooling water temperature sensor (hereinafter called TWS) 56, an atmospheric temperature sensor (hereinafter called TAS) 136, a regulation voltage generator (hereinafter called VRS) 138, a throttle sensor (hereinafter called OTHS) 140 and an oxygen sensor (hereinafter called $O_2S$), 142. MPX 162 selects one of the inputs and applies it to an analog-digital converter circuit (hereinafter called ADC) 164. A digital output of the ADC 164 is held in a register (hereinafter called REG) 166.

The output of a flow rate sensor (hereinafter called AFS) 24, on the other hand, is applied to ADC2 124, and converted into a digital value through an analog-digital converter circuit (hereinafter called ADC) 172 and is set in a register (hereinafter called REG) 174.

An angle sensor (hereinafter called ANGLS) 146 produces a signal representing a reference crank angle such as 180 degree (hereinafter called REF) and a signal representing a small angle such as 1 degree (hereinafter POS) and applies them to an angular signal processing circuit 126 for waveform shaping.

DIO 128 is supplied with signals from an idle switch 148 (hereinafter called IDLE-SW) which operate when the throttle valve 14 is returned to the full-closed position, a top gear switch (hereinafter called TOP-SW) 150 and a starter switch (hereinafter called START-SW) 152.

Now, a circuit for producing a pulse based on the result of computation of CPU and objects of control will be explained. An injector control circuit (hereinafter called INJC) 1134 is for converting a digital computation result into a pulse output. A pulse INJ having a duration corresponding to the fuel injection amount is produced by INJC 1134 and applied through an AND gate 1136 to the injector 12.

An ignition pulse generator circuit (hereinafter called IGNC) 1138 includes a register (hereinafter called ADV) for setting an ignition timing and a register (hereinafter called DWL) for setting an ignition coil primary current start timing. These data are set by CPU. The pulse IGN is generated on the basis of the data thus set, and is applied through an AND gate 1140 to an amplifier 62 for supplying a primary current to the ignition coil.

The opening rate of the bypass valve 61 is controlled by a pulse ISC applied thereto through the AND gate 1144 from a control circuit 1142 (hereinafter called ISCC). ISCC 1142 has a register ISCD for setting a pulse duration and a register ISCP for setting a pulse period.

An EGR amount control pulse generator circuit (hereinafter called EGRC) 1178 for controlling the EGR control valve 90 includes a register EGRD for setting a value representing a duty cycle of the pulse and a register EGRP for setting a value representing a pulse period. The output pulse EGR of this EGRC is applied through the AND gate 1156 to a transistor 90.

The 1-bit input/output signal, on the other hand, is controlled by the circuit DIO 128. Input signals include the IDLE-SW signal, the START-SW signal and the TOP-SW signal, while the output signals include a pulse output signal for driving the fuel pump. This DIO includes a register DDR 192 for determining whether or not a terminal is used as an input terminal and the register DOUT 194 for latching the output data.

A mode register (hereinafter called MOD) 1160 is for holding commands for specifying various conditions in the input/output circuit 108. By setting a command in this mode register 1160, for example, all the AND gates 1136, 1140, 1144 and 1156 can be actuated or deactivated as desired. It is thus possible to control the start and stop of the output of the INJC, IGNC and ISCC by setting a command in the MOD register 1160.

DIO 128 produces a signal DIO1 for controlling the fuel pump 32.

We claim:

1. In a method of controlling fuel injection in an internal combustion engine wherein the fuel injection timing for operation of a fuel injector is based at least on a basic fuel injection time and a steady-state compensation factor which is stored in memory for each of a plurality of operating regions formed by a range of values of at least two predetermined engine conditions, a method of controlling fuel injection during acceleration of the engine, comprising the steps of:

(a) detecting whether said internal combustion engine is in a state of acceleration;

(b) if said internal combustion engine is in a state of acceleration, detecting whether the air/fuel ratio has exceeded a predetermined upper limit value;

(c) if the air/fuel ratio has exceeded a predetermined upper limit value while the internal combustion engine is in a state of acceleration, storing in an acceleration table a transient compensation factor having a value related to the amount by which the air/fuel ratio exceeds said predetermined upper limit value, said transient compensation factor being stored at a storage location in said acceleration table identified by at least two predetermined engine conditions; and (d) determining the fuel injection timing during acceleration of said internal combustion engine on the basis of said basic fuel injection time, a steady-state compensation factor obtained from memory and a transient compensation factor read out of a storage location of said acceleration table according to said two predetermined engine conditions.

2. A method according to claim 1, wherein said step of detecting whether said internal combustion engine is in a state of acceleration is effected by monitoring at least one operating condition of the engine.

3. A method according to claim 2, wherein said operating condition monitored to detect state of acceleration is the rate of change of the basic fuel injection time.

4. A method according to claim 1, wherein values of said transient compensation factor are stored in said acceleration table on the basis of engine speed and engine load.

5. A method according to claim 1, wherein said basic fuel injection time is determined from intake air quantity and engine speed.

6. In a method of controlling fuel injection in an internal combustion engine wherein the fuel injection timing for operation of a fuel injector is based at least on a basic fuel injection time and a steady-state compensation factor which is stored in memory for each of a plurality of operating regions formed by a range of values of at least two predetermined engine conditions, a method of controlling fuel injection during deceleration of the engine, comprising the steps of:

(a) detecting whether said internal combustion engine is in a state of deceleration;

(b) if said internal combustion engine is in a state of deceleration; detecting whether the air/fuel ratio has exceeded a predetermined lower limit value;

(c) if the air/fuel ratio has exceeded a predetermined lower limit value while the internal combustion engine is in a state of deceleration, storing in a deceleration table a transient compensation factor having a value related to the amount by which the air/fuel ratio exceeds said predetermined lower limit value, said transient compensation factor being stored in said deceleration table at a storage location identified by at least two predetermined engine conditions; and (d) determining the fuel injection timing during deceleration of said internal combustion engine on the basis of said basis fuel injection time, a steady-state compensation factor obtained from memory and a transient compensation factor read out of a storage location of said deceleration table according to said two predetermined engine conditions.

7. A method according to claim 6, wherein said step of detecting whether said internal combustion engine is in a state of deceleration is effected by monitoring at least one operating conditions of the engine.

8. A method according to claim 7, wherein said operating condition monitored to detect state of deceleration is the rate of change of the basic fuel injection time.

9. A method according to claim 6, further including the steps of:

(h) during deceleration of the engine, detecting when the basic fuel injection time is shorter than a predetermined basic fuel injection time for an idling condition of the engine; and (i) subtracting from the fuel injection timing a predetermined shift factor so as to compensate for sudden deceleration of the engine.

10. A method according to claim 9, wherein said predetermined shift factor is determined by the difference between an air/fuel ratio compensation factor and 1.0 and values of said predetermined shift factor are stored in storage locations identified by at least two predetermined engine conditions.

11. A method according to claim 6, wherein values of said transient compensation factor are stored in said acceleration table and said deceleration table on the basis of engine speed and engine load.

12. A method according to claim 6, wherein said basic fuel injection time is determined from intake air quantity and engine speed.

13. In a method of controlling fuel injection in an internal combustion engine wherein the fuel injection timing for operation of a fuel injector is based at least on a basic fuel injection time and a steady-state compensation factor which is stored in memory for each of a plurality of operating regions formed by a range of values of at least two predetermined engine conditions, a method of controlling fuel injection during acceleration or deceleration of the engine, comprising the steps of:

(a) detecting whether said internal combustion engine is in a state of acceleration or deceleration;

(b) if said internal combustion engine is in a state of acceleration, detecting whether the air/fuel ratio has exceeded a predetermined upper limit value;

(c) if the air/fuel ratio has exceeded a predetermined upper limit value while the internal combustion engine is in a state of acceleration, storing in an acceleration table a transient compensation factor having a value related to the amount by which the air/fuel ratio exceeds said predetermined upper limit value, said transient compensation factor being stored at a storage location in said acceleration table identified by at least two predetermined engine conditions;

(d) if said internal combustion engine is in a state of deceleration; detecting whether the air/fuel ratio has exceeded a predetermined lower limit value;

(e) if the air/fuel ratio has exceeded a predetermined lower limit value while the internal combustion engine is in a state of deceleration, storing in a deceleration table a transient compensation factor having a value related to the amount by which the air/fuel ratio exceeds said predetermined lower limit value, said transient compensation factor being stored in said deceleration table at a storage location identified by at least two predetermined engine conditions;

(f) determining the fuel injection timing during acceleration of said internal combustion engine on the basis of said basic fuel injection time, a steady-state compensation factor obtained from memory and a transient compensation factor read out of a storage location of said acceleration table according to said two predetermined engine conditions; and (g) determining the fuel injection timing during deceleration of said internal combustion engine on the basis of said basic fuel injection time, a steady-state compensation factor obtained from memory and a transient compensation factor read out of a storage location of said deceleration table according to said two predetermined engine conditions.

14. A method according to claim 13, wherein said step of detecting whether said internal combustion engine is in a state of acceleration or deceleration is effected by monitoring at least one operating condition of the engine.

15. A method according to claim 13, wherein said operating condition monitored to detect state of acceleration or deceleration is the rate of change of the basic fuel injection time.

16. A method according to claim 13, further including the steps of:

(h) during deceleration of the engine, detecting when the basic fuel injection time is shorter than a predetermined basic fuel injection time for an idling condition of the engine; and (i) subtracting from the fuel injection timing a predetermined shift factor so as to compensate for sudden deceleration of the engine.

17. A method according to claim 16, wherein said predetermined shift factor is determined by the difference between an air/fuel ratio compensation factor and 1.0 and values of said predetermined shift factor are stored in storage locations identified by at least two predetermined engine conditions.

18. A method according to claim 13, wherein values of said transient compensation factor are stored in said acceleration table and said deceleration table on the basis of engine speed and engine load.

19. A method according to claim 13, wherein said basic fuel injection time is determined from intake air quantity and engine speed.

* * * * *